US009950888B2

(12) United States Patent
Yonemura

(10) Patent No.: US 9,950,888 B2
(45) Date of Patent: Apr. 24, 2018

(54) DOCUMENT CONVEYING APPARATUS, CONTROL METHOD, AND CONTROL PROGRAM

(71) Applicant: PFU LIMITED, Kahoku-shi, Ishikawa (JP)

(72) Inventor: Shigeru Yonemura, Kahoku (JP)

(73) Assignee: PFU LIMITED, Kahoku-Shi, Ishikawa (JP)

( * ) Notice: Subject to any disclaimer, the term of this patent is extended or adjusted under 35 U.S.C. 154(b) by 0 days.

(21) Appl. No.: 15/337,263

(22) Filed: Oct. 28, 2016

(65) Prior Publication Data

US 2018/0029815 A1 Feb. 1, 2018

(30) Foreign Application Priority Data

Jul. 29, 2016 (JP) ..... 2016-150289

(51) Int. Cl.
*B65H 3/06* (2006.01)
*B65H 7/18* (2006.01)
(Continued)

(52) U.S. Cl.
CPC ..... *B65H 7/18* (2013.01); *B41J 11/04* (2013.01); *B65H 3/06* (2013.01); *B65H 5/06* (2013.01);
(Continued)

(58) Field of Classification Search
CPC ..... B65H 2513/511; B65H 2553/00; B65H 29/00; B65H 5/00; B65H 7/00;
(Continued)

(56) References Cited

U.S. PATENT DOCUMENTS 4,556,209 A * 12/1985 Tsubo ..... B65H 3/0661 271/10.16
5,226,741 A * 7/1993 Kumazaki ..... B41J 13/036 271/21
(Continued)

FOREIGN PATENT DOCUMENTS

JP H07017651 A 1/1995
JP H07041193 A 2/1995
(Continued)

OTHER PUBLICATIONS

Office Action for Japanese Patent Application No. 2016-150289, dated Aug. 1, 2017, 3 pages (with English translation, 4 pages).

*Primary Examiner* — Thomas A Morrison
(74) *Attorney, Agent, or Firm* — Lewis Roca Rothgerber Christie LLP

(57) ABSTRACT

The document conveying apparatus includes a separation roller, a conveying roller, a driving force generation module configured to be capable of generating a first driving force with a rotation in a first direction, and capable of generating a second driving force with a rotation in a second direction opposite to the first direction, a driving force transmission module, a determination module for determining whether a document has passed the separation roller, and a control module for switching a driving force from the first driving force to the second driving force in accordance with a determination result. The driving force transmission module performs separation operation by transmitting the first driving force to the separation roller, and conveys the documents by transmitting the second driving force to the conveying roller and cuts off transmission of the second driving force to the separation roller, in accordance with the switching.

4 Claims, 12 Drawing Sheets

(51) Int. Cl.
*B41J 11/04* (2006.01)
*B65H 5/06* (2006.01)

(52) U.S. Cl.
CPC ..... *B65H 2403/72* (2013.01); *B65H 2801/39* (2013.01)

(58) Field of Classification Search
CPC .... B65H 85/00; B65H 2301/33; B65H 9/004; B65H 7/02; B65H 7/08; B65H 7/10; B65H 9/00; B65H 9/20; B65H 7/18; B65H 3/06; B41J 11/04
See application file for complete search history.

(56) References Cited

U.S. PATENT DOCUMENTS

| | | | | |
|---|---|---|---|---|
| 5,678,488 | A * | 10/1997 | Yamaguchi | B41J 13/103 101/483 |
| 7,347,419 | B2 * | 3/2008 | Sano | B65H 5/062 271/242 |
| 2012/0051818 | A1 | 3/2012 | Yamaguchi et al. | |

FOREIGN PATENT DOCUMENTS

| | | | |
|---|---|---|---|
| JP | 2001-233458 | A | 8/2001 |
| JP | 2001253595 | A | 9/2001 |
| JP | 2004-43146 | A | 2/2004 |
| JP | 2012-66936 | A | 4/2012 |

* cited by examiner

DOCUMENT CONVEYING APPARATUS, CONTROL METHOD, AND CONTROL PROGRAM

CROSS-REFERENCE TO RELATED APPLICATIONS

This application is based upon and claims the benefit of priority of prior Japanese Patent Application No. 2016-150289, filed on Jul. 29, 2016, the entire contents of which are incorporated herein by reference.

TECHNICAL FIELD

Embodiments discussed in the present specification relate to document conveying technology.

BACKGROUND

A document conveying apparatus such as a scanner includes components such as multiple rollers for conveying documents, and causes a driving force generation module such as a motor to drive each component. In general, in a document conveying apparatus, a single driving force generation module drives multiple components in order to suppress an increase in the electric power consumption. However, when a single driving force generation module is configured to drive multiple components, and drives only a particular component, the other components are driven at the same time, and therefore, it is not easy for a single driving force generation module to appropriately drive components of which uses are different.

A sheet feeding apparatus having a pickup roller, a feed roller disposed downstream of the pickup roller, and a retard roller brought into pressurized contact with the feed roller and configured to drive each roller with a single driving source has been disclosed. The retard roller includes a torque limiter, and when there is no sheet or when a single sheet is conveyed, the retard roller is driven and rotated in a sheet conveying direction, and when multiple overlapping sheets are conveyed, the retard roller rotates backward to separate the sheets. In this sheet feeding apparatus, when the retard roller rotates backward, and the feed roller is driven and rotated in a direction opposite to the sheet conveying direction, a planet gear is used so as not to transmit the rotation of the feed roller to the pickup roller (see Japanese Laid-open Patent Publication No. 2004-43146).

A feeding apparatus including a pick roller for picking up documents placed on a shooter, a separation roller located at a conveying downstream side of the pick roller and configured to separate and feed a document and a preceding feed roller and a subsequent feed roller for conveying the document is disclosed. This feeding apparatus further includes a pressurizing arm for pressurizing the documents placed on the shooter from above and a planet gear for controlling the movement of the pressurizing arm. In this feeding apparatus, the preceding feed roller, the subsequent feed roller, the separation roller, and the pick roller rotate in a document conveying direction in accordance with a normal rotation operation of a stepping motor, so that the documents placed on the shooter are picked up and the picked-up documents are separated and fed. When the stepping motor rotates forward with the planet gear, the pressurizing arm operates to pressurize the documents, and when the stepping motor rotates backward, the pressurizing arm operates so as not to pressurize the documents (see Japanese Laid-open Patent Publication No. 2001-233458).

A color printer including a feeding roller and a retard roller disposed so that its external periphery is in contact with an arc portion of the feeding roller is disclosed. In this color printer, a driving force is input into a feeding gear connected to a feeding roller and a retard gear connected to the retard roller via a transmission mechanism having a planet gear. In this transmission mechanism, when the motor rotates forward, the planet gear is meshed with the feeding gear, and the sheets are separated and conveyed, and when the motor rotates backward, the planet gear is detached from the feeding gear, and the sheets are conveyed by the retard roller (see Japanese Laid-open Patent Publication No. 2012-66936).

SUMMARY

In a case where a separation roller performing a separation operation for separating documents and a conveying roller provided downstream of the separation roller in a document conveying direction are driven by a single driving force generation module, it is necessary to rotate the conveying roller in a direction for conveying the documents and rotate the separation roller in a direction opposite to the direction for conveying the documents. However, when the separation roller is continuously rotated in the direction opposite to the direction for conveying the documents, and a thin sheet and the like is conveyed, the thin sheet may be warped due to the rotation of the separation roller, and this may cause a jam. Therefore, in a case where the separation roller and the conveying roller provided downstream of the separation roller are driven by a single driving force generation module, it is desired to appropriately control driving of each roller.

It is an object to provide a document conveying apparatus and a control method that can appropriately control rotation of each roller in a document conveying apparatus using a single driving force generation module to drive a separation roller and a conveying roller disposed downstream of the separation roller, and a computer-readable, non-transitory medium storing a computer program for causing a document conveying apparatus to implement such a control method.

According to an aspect of the apparatus, there is provided a document conveying apparatus. The document conveying apparatus includes a separation roller for separating documents, a conveying roller provided at a downstream with respect to the separation roller in a document conveying direction, a driving force generation module configured to be capable of generating a first driving force with a rotation in a first direction, and capable of generating a second driving force with a rotation in a second direction opposite to the first direction, a driving force transmission module disposed between the driving force generation module and the separation roller and between the force generation module and the conveying roller, a determination module for determining whether a document has passed the separation roller, and a control module for switching a driving force generated by the driving force generation module from the first driving force to the second driving force in accordance with a determination result made by the determination module. The driving force transmission module performs separation operation by transmitting the first driving force to the separation roller, and conveys the documents by transmitting the second driving force to the conveying roller and cuts off transmission of the second driving force to the separation roller, in accordance with the switching from the first driving force to the second driving force.

According to an aspect of the method, there is provide a control method for a document conveying apparatus including a separation roller for separating documents, a conveying roller provided at a downstream with respect to the separation roller in a document conveying direction, a driving force generation module configured to be capable of generating a first driving force with a rotation in a first direction, and capable of generating a second driving force with a rotation in a second direction opposite to the first direction, a driving force transmission module disposed between the driving force generation module and the separation roller and between the force generation module and the conveying roller. The control method includes determining whether a document has passed the separation roller, and switching a driving force generated by the driving force generation module from the first driving force to the second driving force in accordance with a determination result in the determining step. The driving force transmission module performs separation operation by transmitting the first driving force to the separation roller, and conveys the documents by transmitting the second driving force to the conveying roller and cuts off transmission of the second driving force to the separation roller, in accordance with the switching from the first driving force to the second driving force.

According to an aspect of the computer-readable, non-transitory medium storing a computer program, the computer program causes a document conveying apparatus including a separation roller for separating documents, a conveying roller provided at a downstream with respect to the separation roller in a document conveying direction, a driving force generation module configured to be capable of generating a first driving force with a rotation in a first direction, and capable of generating a second driving force with a rotation in a second direction opposite to the first direction, a driving force transmission module disposed between the driving force generation module and the separation roller and between the force generation module and the conveying roller, to execute a process, including determining whether a document has passed the separation roller, and switching a driving force generated by the driving force generation module from the first driving force to the second driving force in accordance with a determination result in the determining step. The driving force transmission module performs separation operation by transmitting the first driving force to the separation roller, and conveys the documents by transmitting the second driving force to the conveying roller and cuts off transmission of the second driving force to the separation roller, in accordance with the switching from the first driving force to the second driving force.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a document conveying apparatus, a control method, and computer program according to an embodiment, will be described with reference to the drawings. However, note that the technical scope of the invention is not limited to these embodiments and extends to the inventions described in the claims and their equivalents.

Figure 1:
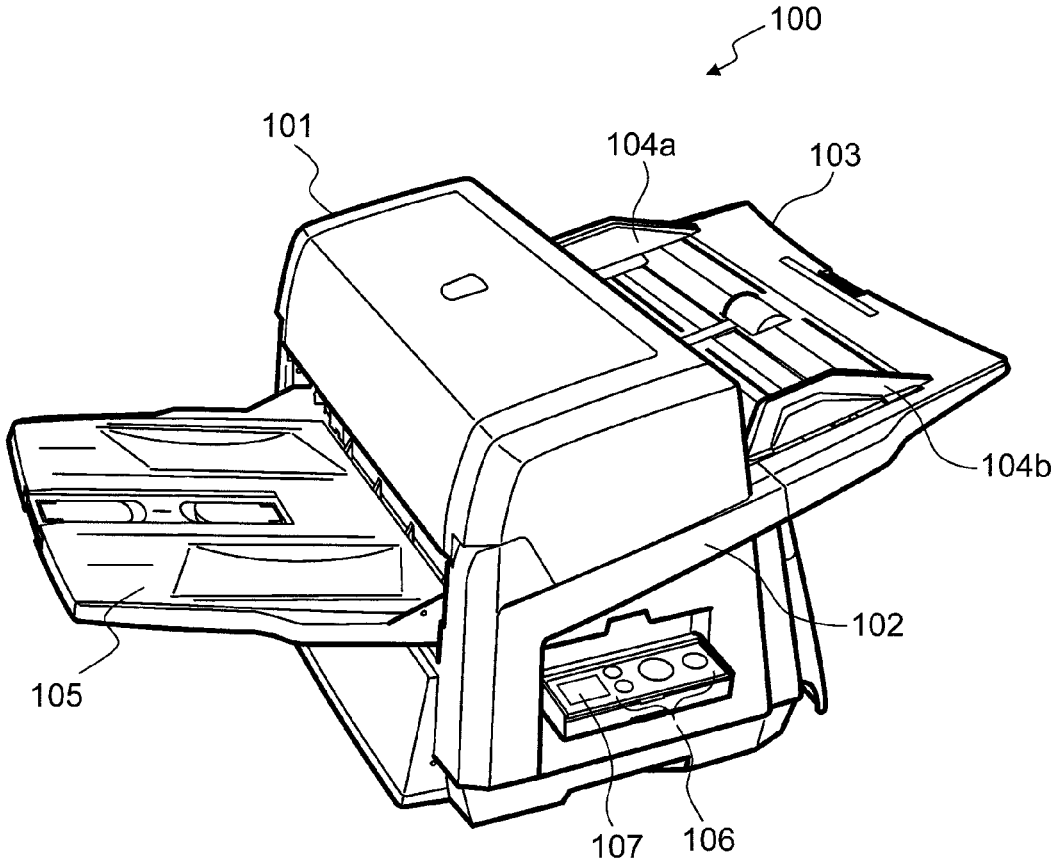
FIG. 1 is a perspective view illustrating a document conveying apparatus 100.

FIG. 1 is perspective view illustrating a document conveying apparatus 100 configured as an image scanner according to an embodiment.

The document conveying apparatus 100 includes an upper side housing 101, a lower side housing 102, a document tray 103, a discharged sheet stacker 105, multiple operation buttons 106, a display device 107, etc.

The upper side housing 101 is arranged at a position to cover the upper surface of the document conveying apparatus 100, and is attached to the lower side housing 102 with a hinge so as to be able to open and close, at the time of a paper jam, at the time of cleaning of the document conveying apparatus 100, etc.

The document tray 103 is engaged with the lower side housing 102 in such a manner that the document can be placed on the document tray 103. The document tray 103 is provided with side guides 104*a* and 104*b* which can move in a direction perpendicular to the conveying direction of the document. Hereinafter, the side guides 104*a* and 104*b* may be collectively referred to as side guides 104.

The discharged sheet stacker 105 engages with the lower side housing 102 so that the discharged document can be held.

The operation button 106 is arranged on a side portion of the lower side housing 102, and when the operation button 106 is pressed down, the operation button 106 generates and outputs an operation detection signal in accordance with the button.

The display device 107 includes a display constituted by a liquid crystal, an organic EL (Electro-Luminescence), etc., and an interface circuit for outputting image data to the display, and displays the image data to the display.

Figure 2:
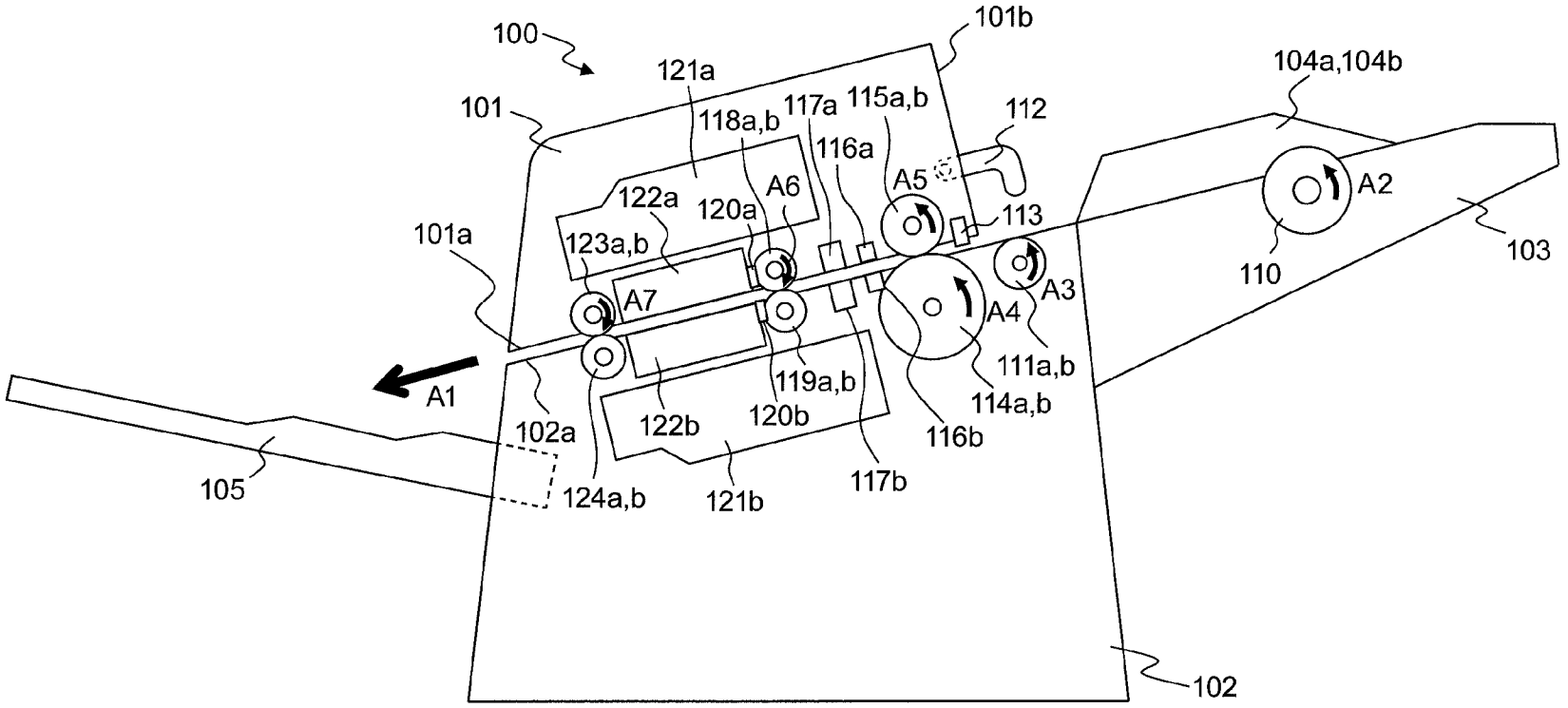
FIG. 2 is a figure for explaining a conveying path in the document conveying apparatus 100.

FIG. 2 is a figure for explaining a conveying path inside of the document conveying apparatus 100.

The conveying path inside of the document conveying apparatus 100 includes a shoot roller 110, a pick roller 111*a*, 111*b*, a pick arm 112, a contact sensor 113, feeding rollers 114*a*, 114*b*, retard rollers 115*a*, 115*b*, a first light emitter 116*a*, a first light receiver 116*b*, an ultrasonic transmitter 117*a*, an ultrasonic receiver 117*b*, first conveying rollers 118*a*, 118*b*, first driven rollers 119*a*, 119*b*, a second light emitter 120*a*, a second light receiver 120*b*, a first image capturing device 121*a*, a second image capturing device 121*b*, a first illumination device 122*a*, a second illumination device 122*b*, second conveying rollers 123*a*, 123*b*, second driven rollers 124*a*, 124*b*, etc.

In the following explanation, the pick roller 111*a* and 111*b* may be collectively referred to as the pick roller 111. The feeding rollers 114*a* and 114*b* may be collectively referred to as the feeding roller 114. The retard rollers 115*a* and 115*b* may be collectively referred to as the brake roller 115. The first conveying rollers 118*a* and 118*b* may be collectively referred to as the first conveying roller 118. The first driven rollers 119*a* and 119*b* may be collectively referred to as the first driven roller 119. The second conveying rollers 123*a* and 123*b* may be collectively referred to as the second conveying roller 123. The second driven rollers 124*a* and 124*b* may be collectively referred to as the second driven roller 124.

The lower surface of the upper side housing 101 forms a upper side guide 108*a* of the conveying route for the documents, and the upper surface of the lower side housing 102 forms an lower side guide 108*b* of the conveying route for the documents. In FIG. 2, arrow A1 indicates the conveying direction of the documents. In the following explanation, the upstream means the upstream in the conveying direction A1 of the documents, and the downstream means the downstream in the conveying direction A1 of the documents.

The shoot roller 110 is provided in the document tray 103, and is configured to be in contact with one of documents stacked on the document tray 103 and located at the lowermost position, so that the shoot roller 110 feeds the documents in the document conveying direction A1.

The pick roller 111 is provided in the lower side housing 102, and is configured to be in contact with one of documents stacked on the document tray 103 in such a manner that the leading edges thereof is butted against a butted part 101*b* of the upper side housing 101 and located at the lowermost position, and feeds the documents in the document conveying direction A1. With the actions performed by the shoot roller 110 and the pick roller 111, the document conveying apparatus 100 conveys the documents in accordance with so-called lower side retrieval method.

The pick arm 112 is provided on the upper side housing 101 in such a manner that the pick arm 112 is at a position facing the pick roller 111. The pick arm 112 pressurizes, from above, documents placed on the document tray 103 in such a manner that an appropriate frictional force is generated between the pick roller 111 and the documents placed on the document tray 103 to enable the pick roller 111 to convey the documents in a preferable manner.

The contact sensor 113 is provided at the upstream side with respect to the feeding roller 114 and the retard roller 115, and detects whether or not a document is placed on the document tray 103. The contact sensor 113 generates and outputs a first document detection signal of which signal value changes depending on a state in which the document is placed on the document tray 103 and a state in which the document is not placed on the document tray 103.

The feeding roller 114 is provided in the lower side housing 102, and feeds the documents placed on the document tray 103 in the document conveying direction A1. The retard roller 115 is an example of a separation roller, and is provided in the upper side housing 101 in such a manner that the retard roller 115 is located at a position facing the feeding roller 114. The retard roller 115 performs separation operation of documents.

The first light emitter 116*a* and the first light receiver 116*b* are provided at the downstream side with respect to the feeding roller 114 and the retard roller 115 and at the upstream side with respect to the first conveying roller 118 and the first driven roller 119, and are arranged to face each other with the conveying route for the documents interposed therebetween. The first light emitter 116*a* emits light to the first light receiver 116*b*. The first light receiver 116*b* detects light emitted from the first light emitter 116*a*, and generates and outputs a second document detection signal which is an electric signal according to the detected light. More specifically, the second document detection signal is a signal of which the value changes depending on a state in which a document exists between the first light emitter 116*a* and the first light receiver 116*b* and a state in which a document does not exist between the first light emitter 116*a* and the first light receiver 116*b*. Hereinafter, the first light emitter 116*a* and the first light receiver 116*b* may be collectively referred to as the first light sensor 116.

The ultrasonic transmitter 117*a* and the ultrasonic receiver 117*b* are arranged in proximity to the conveying route for the documents so as to face each other with the conveying route interposed therebetween. The ultrasonic transmitter 117*a* transmits an ultrasonic wave. On the other hand, the ultrasonic receiver 117*b* detects the ultrasonic wave that has been transmitted by the ultrasonic transmitter 117*a* and that has passed through a document, and generates and outputs an ultrasonic signal which is an electric signal according to the detected ultrasonic wave. In the following explanation, the ultrasonic transmitter 117*a* and the ultrasonic receiver 117*b* may be collectively referred to as the ultrasonic sensor 117.

The first conveying roller 118 is provided in the upper side housing 101 in such a manner that, in the document conveying direction A1, the first conveying roller 118 is at a downstream side with respect to the retard roller 115 and at an upstream side with respect to the first image capturing device 121*a*. The first driven roller 119 is provided in the lower side housing 102 in such a manner that the first driven roller 119 is located at a position facing the first conveying roller 118.

The second light emitter 120*a* and the second light receiver 120*b* are disposed at a downstream side with respect to the first conveying roller 118 and the first driven roller 119 and at an upstream side with respect to the first illumination device 122*a* and the second illumination device 122*b* (i.e., the imaging positions of the first image capturing device 121*a* and the second image capturing device 121*b*) in such a manner that the second light emitter 120*a* and the second light receiver device 120*b* are disposed to face each other with a conveying path of a document interposed therebetween. The second light emitter 120*a* emits light to the second light receiver 120*b*. The second light receiver 120*b* detects light emitted from the second light emitter 120*a*, and generates and outputs a third document detection signal which is an electric signal according to the detected light. More specifically, the third document detection signal is a signal of which the value changes depending on a state in which a document exists between the second light emitter 120*a* and the second light receiver 120*b* and a state in which a document does not exist between the second light emitter 120*a* and the second light receiver 120*b*. Hereinafter, the second light emitter 120*a* and the second light receiver 120*b* may be collectively referred to as the second light sensor 120.

The first image capturing device 121*a* includes an image capturing sensor of a reduced optical system type having an image capturing device based on CCD (Charge Coupled Device) arranged in a linear manner in a main scanning direction. This image capturing sensor reads the back surface of the document, and generates and outputs an analog image signal. Likewise, the second image capturing device 121*b* includes an image capturing sensor of a reduced optical system type based on CCD arranged in the linear manner in the main scanning direction. This image capturing sensor generates and outputs an analog image signal by reading the front surface of the document. It should be noted that only one of the first image capturing device 121*a* and the second image capturing device 121*b* may be provided to read only one of the surfaces of a document. Alternatively, it may possible to use a CIS (Contact Image Sensor) of the same-size optical system type having an image capturing device based on CMOS (Complementary Metal Oxide Semiconductor) instead of the CCD. Hereinafter, the first image capturing device 121*a* and the second image capturing device 121*b* may be collectively referred to as the image capturing device 121.

The first illumination device 122*a* includes a light source for illuminating the back surface of a document and a backing that is used for the front surface of the document, and is arranged at a position between the first image capturing device 121*a* and the document conveying route so that the first illumination device 122*a* faces the second image capturing device 121*b*. Likewise, the second illumination device 122*b* includes a light source for illuminating the front surface of a document and a backing that is used for the back surface of the document, and is arranged at a position between the second image capturing device 121*b* and the document conveying route so that the second illumination device 122*b* faces the first image capturing device 121*a*. Hereinafter, the first illumination device 122*a* and the second illumination device 122*b* may be collectively referred to as the illumination device 122.

The second conveying roller 123 is provided in the upper side housing 101 in such a manner that the second conveying roller 123 is at a downstream side with respect to the first image capturing device 121*a* and the retard roller 115 in the document conveying direction A1. The second driven roller 124 is provided in the lower side housing 102 in such a manner that the second driven roller 124 is located at a position facing the second conveying roller 123.

When the shoot roller 110, the pick roller 111, and the feeding roller 114 rotate, respectively, in the directions of the arrows A2, A3, A4 in FIG. 2, the documents placed on the document tray 103 is conveyed between the upper side guide 101*a* and the lower side guide 102*a* toward the document conveying direction A1. On the other hand, when multiple documents are stacked on the document tray 103, the retard roller 115 rotates in the direction of the arrow A5, so that only the document in contact with the feeding roller 114 is separated from the documents stacked on the document tray 103.

While the document is guided by the upper side guide 101*a* and the lower side guide 102*a*, the document is fed between the first conveying roller 118 and the first driven roller 119. When the first conveying roller 118 rotates in the direction of the arrow A6, the document is fed between the first illumination device 122*a* and the second illumination device 122*b* (i.e., between the first image capturing device 121*a* and the second image capturing device 121*b*). The document read by the image capturing device 121 is discharged onto the discharged sheet stacker 105 when the second conveying roller 123 rotates in the direction of the arrow A7.

Figure 3:
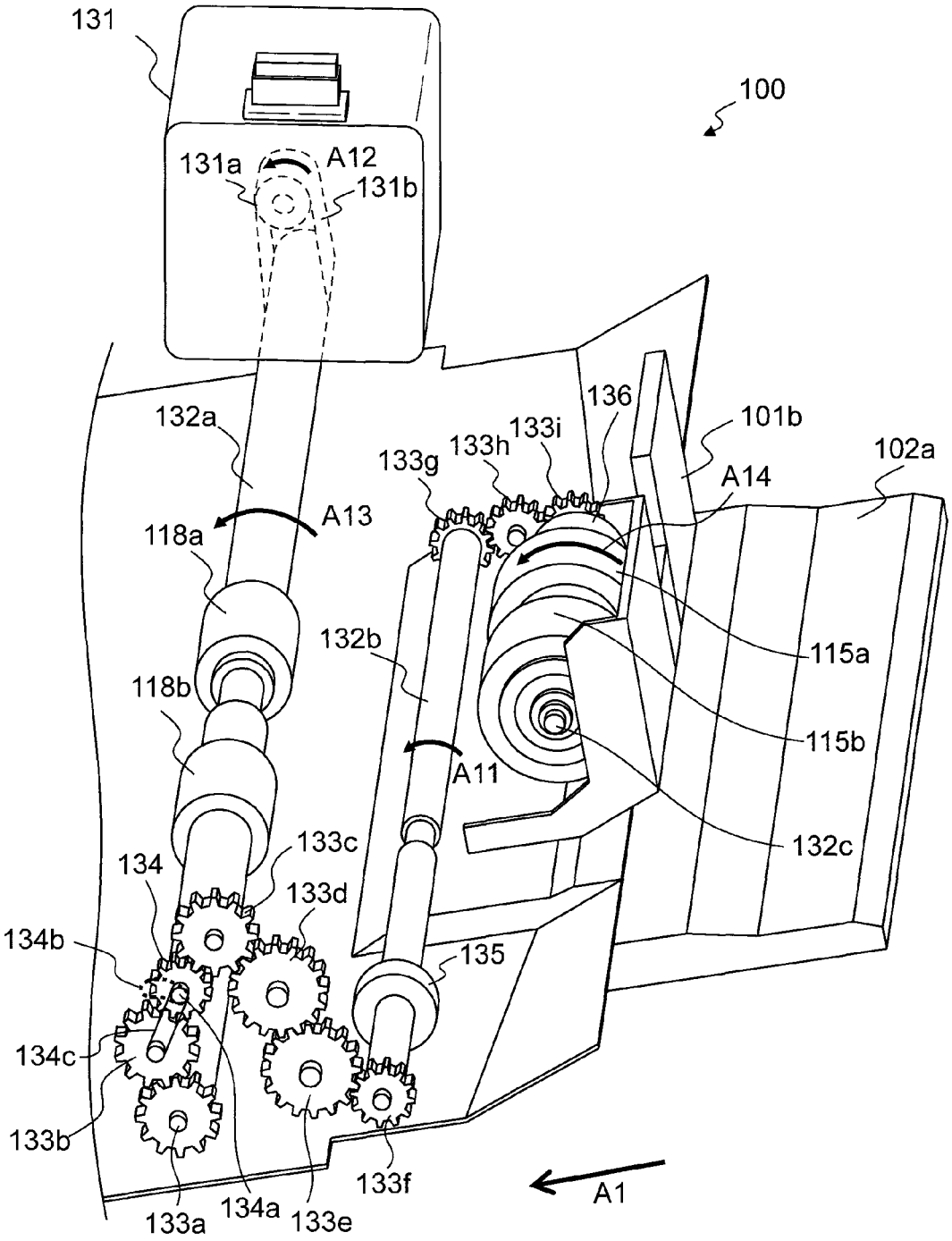
FIG. 3 is a figure for explaining a driving mechanism of the document conveying apparatus 100.

FIG. 3 is a figure for explaining a driving mechanism of the document conveying apparatus 100.

As illustrated in FIG. 3, the driving mechanism of the document conveying apparatus 100 includes not only the retard roller 115 and the first conveying roller 118 explained above but also a first motor 131, first to third rotation shafts 132*a* to 132*c*, first to ninth gears 133*a* to 133*i*, a planet gear 134, a one-way clutch 135, a torque limiter 136, and the like. The first to third rotation shafts 132*a* to 132*c*, the first to ninth gears 133*a* to 133*i*, the planet gear 134, the one-way clutch 135, and the torque limiter 136 are examples of a driving force transmission module disposed between the first motor 131 and the retard roller 115 and between the first motor 131 and the first conveying roller 118.

The first motor 131 is an example of a driving force generation module, and includes a motor rotation shaft 131*a*, and generates driving force for rotating the retard roller 115, the first conveying roller 118, and the second conveying roller 123 via the motor rotation shaft 131*a*.

A belt 131*b* is extended and wrapped between the motor rotation shaft 131*a* of the first motor 131 and an end of the first rotation shaft 132*a*, and a first gear 133*a* is attached to the other end of the first rotation shaft 132*a*. The first conveying roller 118 is attached to a central portion of the first rotation shaft 132*a* in such a manner that the first conveying roller 118 rotates in accordance with the rotation of the first rotation shaft 132*a*. The first gear 133*a* is engaged with the second gear 133*b*, and the second gear 133*b* is engaged with the planet gear 134.

The rotation shaft 134*a* of the planet gear 134 is provided in a movable manner along a groove portion 134*b* provided in a case, not shown, in which the first to sixth gears 133*a* to 133*f* and the planet gear 134 are provided. The rotation shaft 134*a* of the planet gear 134 is supported so that the rotation shaft 134*a* is coupled with the rotation shaft of the second gear 133*b* via a support member 134*c* such as a belt. As a result, the planet gear 134 moves (revolves) along the groove portion 134*b* in accordance with the rotation of the second gear 133*b*. At the right end position of the groove portion 134*b*, the planet gear 134 is engaged with the third gear 133*c*, and at the left end position of the groove portion 134*b*, the planet gear 134 is not engaged with the third gear 133*c*.

The third gear 133*c* is engaged with the fourth gear 133*d*, and the fourth gear 133*d* is engaged with the fifth gear 133*e*, and the fifth gear 133*e* is engaged with the sixth gear 133*f*. The sixth gear 133*f* is attached to one end of the second rotation shaft 132*b*, and the seventh gear 133*g* is attached to the other end of the second rotation shaft 132*b*. The one-way clutch 135 is attached to the central portion of the second rotation shaft 132*b*, so that the second rotation shaft 132*b* rotates only in the direction of the arrow A11 and does not rotate in the opposite direction of the arrow A11. The position where the one-way clutch 135 is attached is not limited to the second rotation shaft 132*b*, and may be any position between the third rotation shaft 132*c* where the retard roller 115 is attached and the rotation shaft 134*a* of the planet gear 134. Further, the seventh gear 133*g* is engaged with the eighth gear 133*h*, and the eighth gear 133*h* is engaged with the ninth gear 133*i*.

The ninth gear 133*i* is attached to one end of the third rotation shaft 132*c*. The retard roller 115 is attached to the central portion of the third rotation shaft 132*c* so that the retard roller 115 rotates in accordance with the rotation of the third rotation shaft 132*c*. Further, the torque limiter 136 is attached to the third rotation shaft 132*c*.

Figure 4A:
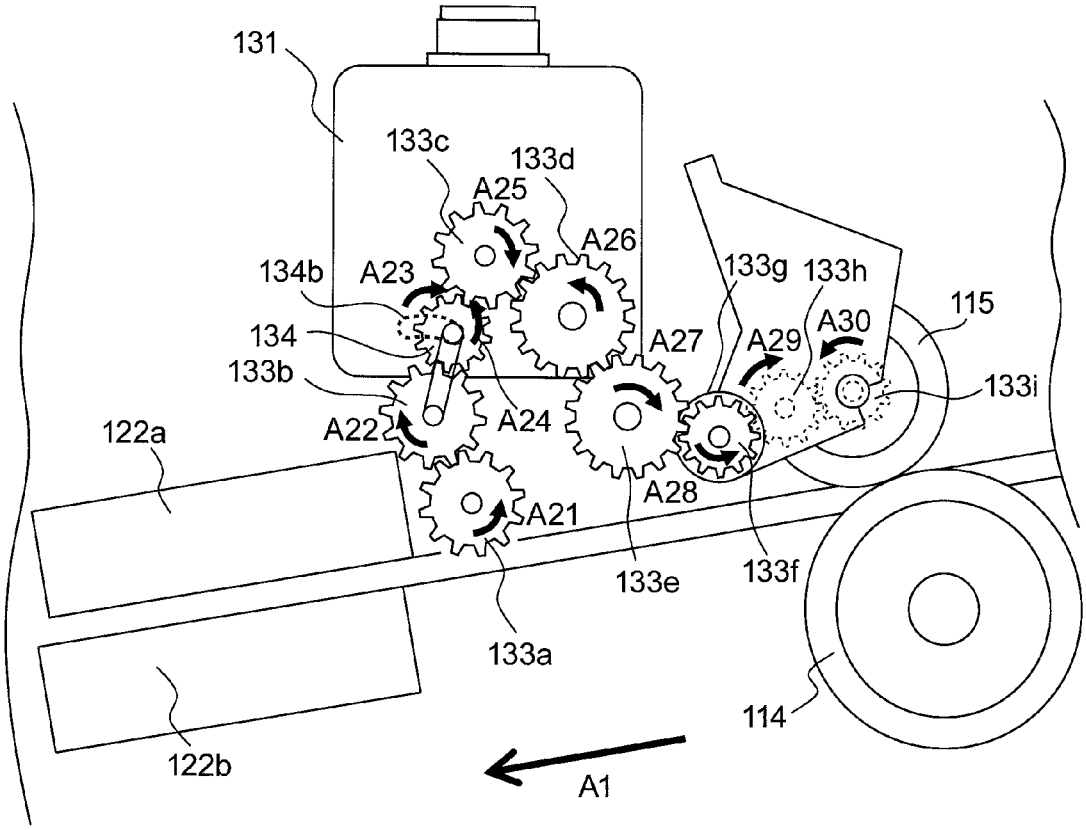
FIG. 4A is a figure for explaining an operation of the driving mechanism of the document conveying apparatus 100.
Figure 4B:
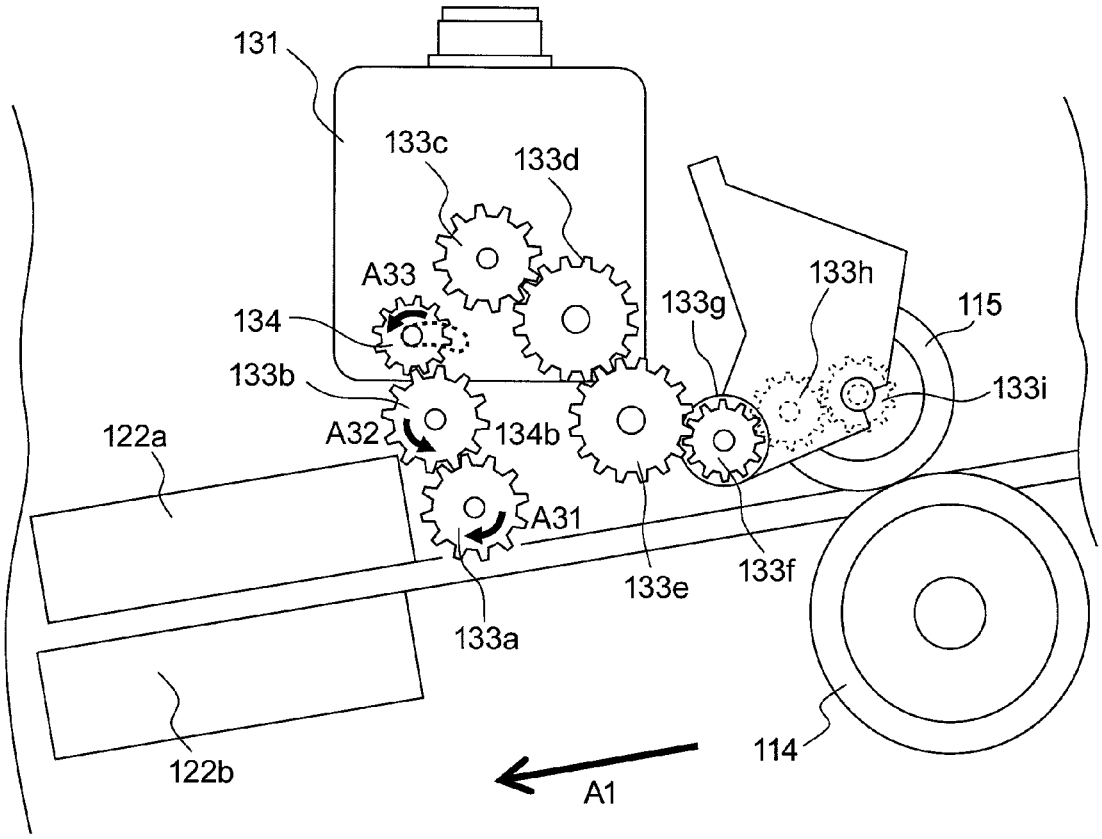
FIG. 4B is a figure for explaining an operation of the driving mechanism of the document conveying apparatus 100.

FIGS. 4A, 4B are figures for explaining an operation of the driving mechanism of the document conveying apparatus 100. In the following explanation, the operation of the driving mechanism of the document conveying apparatus 100 will be explained with reference to FIGS. 3, 4A, and 4B.

The first motor 131 can generate a first driving force in accordance with the rotation in a first direction, and can generate a second driving force in accordance with the rotation in a second direction which is opposite to the first direction. The rotation in the first direction is a rotation for rotating the motor rotation shaft 131*a* in the direction of the arrow A12 in FIG. 3. The rotation in the second direction is a rotation for rotating the motor rotation shaft 131*a* in a direction opposite to the direction of the arrow A12.

When the first motor 131 rotates the first driving force, the first rotation shaft 132*a* rotates in the direction of the arrow A13 in FIG. 3, and accordingly, the first conveying roller 118 attached to the first rotation shaft 132*a* rotates in a direction opposite to the direction for conveying the document. The first gear 133*a* attached to the first rotation shaft 132*a* rotates in the direction of the arrow A21 in FIG. 4A, and the second gear 133*b* rotates in the direction of the arrow A22.

The planet gear 134 engaged with the second gear 133*b* moves (revolves) to the right end positon of the groove portion 134*b* in the direction of the arrow A23 along the groove portion 134*b* in accordance with the rotation of the second gear 133*b*, and as a result, the planet gear 134 engages with the third gear 133*c*. Further, the planet gear 134 rotates (spins) in the direction of the arrow A24 at the right end position of the groove portion 134*b* in accordance with the rotation of the second gear 133*b*.

The third gear 133*c*, the fourth gear 133*d*, the fifth gear 133*e*, and the sixth gear 133*f* rotate, respectively, in the directions of the arrows A25, A26, A27, A28 in accordance with the rotation of the planet gear 134. Further, the seventh gear 133*g*, the eighth gear 133*h*, the ninth gear 133*i* rotate, respectively, in the directions of the arrows A28, A29, A30 via the second rotation shaft 132*b*, and the retard roller 115 rotates in the direction of the arrow A14 in FIG. 3 via the third rotation shaft 132*c*.

It should be noted that the one-way clutch 135 is attached to the second rotation shaft 132*b* so that the second rotation shaft 132*b* does not rotate in a direction opposite to the direction of the arrow A11 in FIG. 3, and the retard roller 115 does not rotate in a direction opposite to the direction of the arrow A14. The torque limit value of the torque limiter 136 attached to the third rotation shaft 132*c* is configured so that, in a case of a single document the rotation force via the torque limiter 136 is cut off, and in a case of multiple documents, the rotation force via the torque limiter 136 is transmitted. Therefore, when only a single document is conveyed, the retard roller 115 does not rotate and is fixed. On the other hand, when multiple documents are conveyed, the retard roller 115 rotates in the direction of the arrow A14, so that the document in contact with the feeding roller 114 is separated from the other documents, and multi-feed is prevented.

As described above, each driving force transmission module transmits the first driving force produced by the first motor 131 to the retard roller 115 via the planet gear 134, and performs separation operation. Further, each driving force transmission module transmits the first driving force to the first conveying roller 118, and rotates the first conveying roller 118 in a direction opposite to the document conveying direction. The one-way clutch 135 blocks the rotation of the retard roller 115 in a direction opposite to the rotation direction of the retard roller 115 with the first driving force.

On the other hand, when the first motor 131 generates the second driving force, the first rotation shaft 132*a* rotates in a direction opposite to the direction of the arrow A13 in FIG. 3, and accordingly, the first conveying roller 118 attached to the first rotation shaft 132*a* rotates in the direction for conveying the document. The first gear 133*a* attached to the first rotation shaft 132*a* rotates in the direction of the arrow A31 of FIG. 4B, and the second gear 133*b* rotates in the direction of the arrow A32.

The planet gear 134 engaged with the second gear 133*b* moves (revolves) in the direction of the arrow A33 to the left end position of the groove portion 134*b* along the groove portion 134*b* in accordance with the rotation of the second gear 133*b*, so that the planet gear 134 no longer engages with the third gear 133*c*. As a result, the second driving force is not transmitted to the third to ninth gears 133*c* to 133*i*, the second to third rotation shafts 132*b* to 132*c*, and the retard roller 115, and accordingly, each unit no longer rotates.

As described above, the one-way clutch 135 is attached to the second rotation shaft 132*b* so that the second rotation shaft 132*b* does not rotate in a direction opposite to the direction of the arrow A11 in FIG. 3, and accordingly, the retard roller 115 does not rotate in a direction opposite to the direction of the arrow A14. Therefore, even when a document is being conveyed, the retard roller 115 does not rotate and is fixed, so that multi-feed is prevented.

As described above, each driving force transmission module transmits the second driving force produced by the first motor 131 to the first conveying roller 118 to convey documents, and when the coupling of the planet gear 134 is changed, the transmission of the second driving force to the retard roller 115 is cut off.

The second conveying roller 123 is also connected to the first motor 131 via a driving mechanism (driving force transmission module), not shown, and is controlled to rotate just like the first conveying roller 118.

Figure 5:
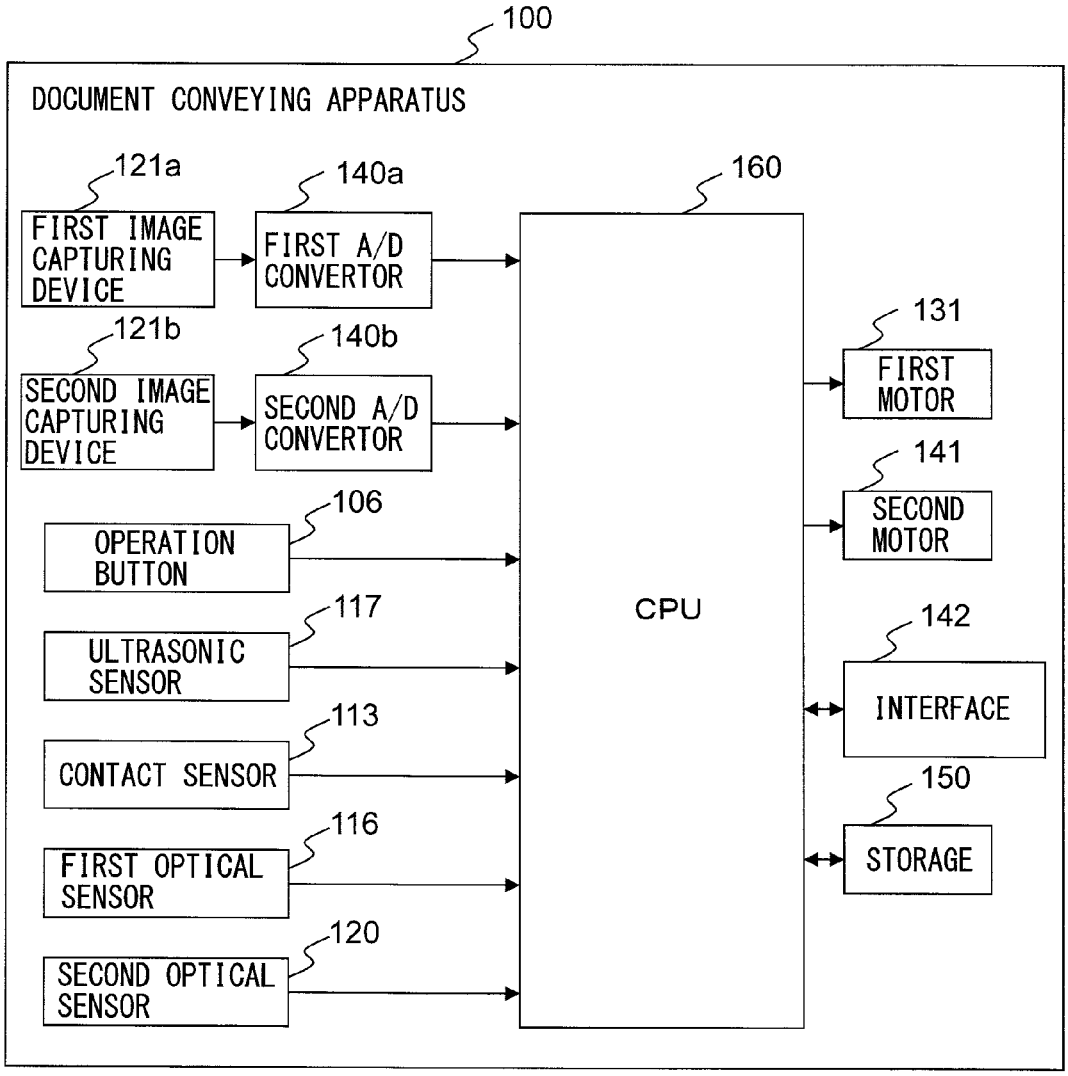
FIG. 5 is a block diagram illustrating a schematic configuration of the document conveying apparatus 100.

FIG. 5 is a block diagram illustrating a schematic configuration of the document conveying apparatus 100.

The document conveying apparatus 100 includes not only the configuration described above but also a first A/D convertor 140*a*, a second A/D convertor 140*b*, a second motor 141, an interface 142, a storage 150, a CPU (Central Processing Unit) 160, etc.

The first A/D converter 140*a* performs analog digital conversion to convert an analog image signal which is output from the first image capturing device 121*a*, and generate digital image data, and outputs the digital image data to the CPU 160. Likewise, the second A/D converter 140*b* performs analog digital conversion to convert an analog image signal which is output from the second image capturing device 121*b*, and generate digital image data, and outputs the digital image data to the CPU 160. These digital image data are used as read image. Hereinafter, the first A/D converter 140*a* and the second A/D converter 140*b* may be collectively referred to as the A/D converter 140.

The second motor 141 is a motor different from the first motor 131, and includes one or multiple motors. In accordance with a control signal from the CPU 160, the second motor 141 rotates the shoot roller 110, the pick roller 111, and the feeding roller 114 to perform the conveying operation of documents.

The interface 142 includes, for example, an interface circuit based on a serial bus such as USB, and electrically connects with an information processing apparatus, not shown (for example, a personal computer, a portable information terminal, etc.), and transmits and receives read images and various kinds of information. Instead of the interface 142, an antenna for transmitting and receiving a wireless signal and a communication module having a wireless communication interface circuit for transmitting and receiving a signal via a wireless communication circuit in accordance with a predetermined communication protocol may be used. The predetermined communication protocol may be, for example, a wireless LAN (Local Area Network).

The storage 150 includes memory devices such as a RAM (Random Access Memory), a ROM (Read Only Memory), etc., a fixed disk device such as a hard disk, or a portable storage device such as a flexible disk, an optical disk, etc. The storage 150 stores computer programs, databases, tables, etc., used for various kinds of processing of the document conveying apparatus 100. The computer program may be installed on the storage 150 from a computer-readable, non-transitory medium such as a compact disk read only memory (CD-ROM), a digital versatile disk read only memory (DVD-ROM), etc., by using a well-known setup program, etc. Further, the storage 150 stores the read images.

The CPU 160 operates based on a program stored in the storage 150 in advance. Alternatively, a DSP (digital signal processor), an LSI (large scale integration), etc., may be used instead of the CPU 150. As another alternative, an ASIC (Application Specific Integrated Circuit), an FPGA (Field-Programming Gate Array), etc., may be used instead of the CPU 150.

The CPU 160 is connected to the operation button 106, the contact sensor 111, the first light sensor 116, the ultrasonic sensor 117, the second light sensor 120, the image capturing device 121, the A/D converter 140, the first motor 131, the second motor 141, the interface 142, the storage 150, etc., and controls each of these modules. The CPU 160 performs driving control of the first motor 131 and the second motor 141, document reading control of the image capturing device 121, etc., and obtains read images.

Figure 6:
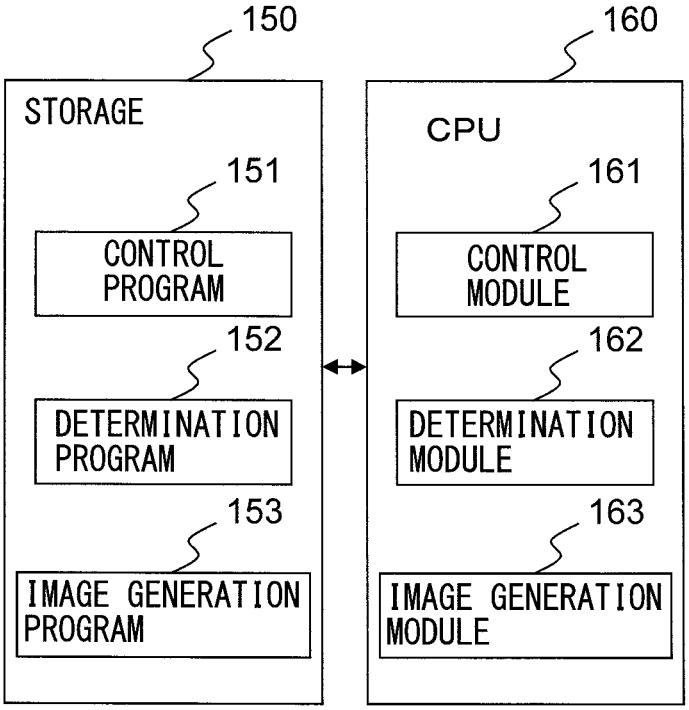
FIG. 6 is a figure illustrating a schematic configuration of a storage 150 and a CPU 160.

FIG. 6 is a figure illustrating a schematic configuration of a storage 150 and a CPU 160.

As illustrated in FIG. 6, the storage 150 stores programs such as a control program 151, a determination program 152, and an image generation program 153. These programs are functional modules implemented by software operating on a processor. The CPU 160 reads the programs stored in the storage 150, and operates in accordance with the read programs, so that the CPU 160 functions as a control module 161, a determination module 162, and an image generation module 163.

Figure 7:
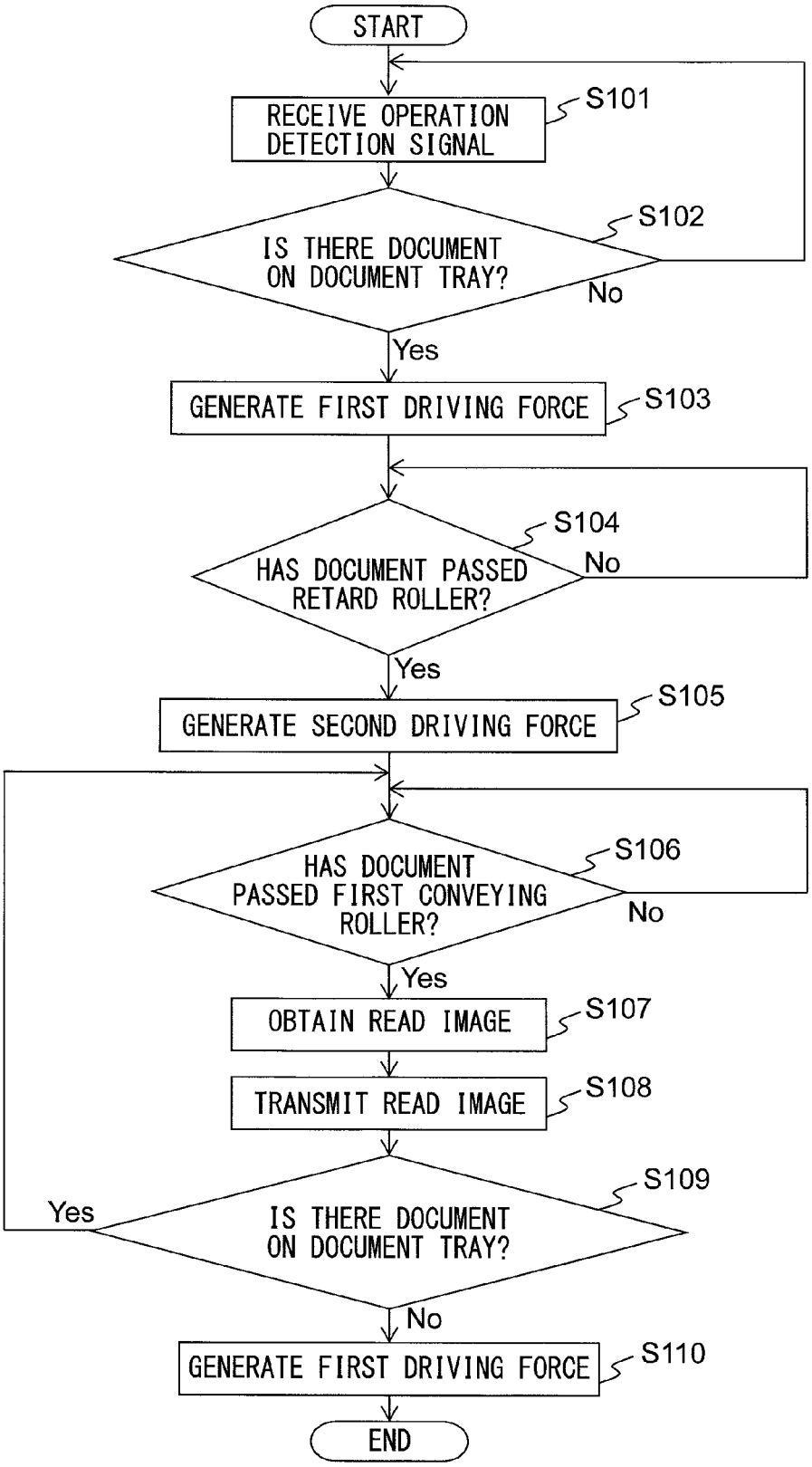
FIG. 7 is a flowchart illustrating an example of an operation of document reading processing.

FIG. 7 is a flow chart illustrating an example of an operation of document reading processing of the document conveying apparatus 100.

Hereinafter, an example of an operation of the entire processing of the document conveying apparatus 100 will be explained with reference to the flow chart as depicted in FIG. 7. It should be noted that the flow of the operation explained below is executed mainly by the CPU 160 in cooperation with each element of the document conveying apparatus 100 based on a program stored in the storage 150 in advance.

At first, the control module 161 waits until the control module 161 receives, from the operation button 106, an operation detection signal for commanding reading a document when a user presses down the operation button 106 for commanding reading of the document (step S101).

Subsequently, the control module 161 determines whether documents are placed on the document tray 103 or not based on a first document detection signal received from the contact sensor 113 (step S102).

When documents are not placed on the document tray 103, the control module 161 returns back to the processing in step S101, and waits until the control module 161 receives a new operation detection signal from the operation button 106.

On the other hand, when documents are placed on the document tray 103, the control module 161 drives the second motor 141 to rotate the shoot roller 110, the pick roller 111 and the feeding roller 114 to convey the documents. Further, the control module 161 causes the first motor 131 to generate the first driving force to rotate the retard roller 115, the first conveying roller 118, and the second conveying roller 123 (step S103).

As a result, the shoot roller 110, the pick roller 111, and the feeding roller 114 rotate, respectively, in the directions of the arrows A2, A3, and A4 in FIG. 2. On the other hand, the driving mechanism of the document conveying apparatus 100 attains the state as illustrated in FIG. 4A. More specifically, the retard roller 115 rotates in the direction of the arrow A5 in FIG. 2, and the first conveying roller 118 and the second conveying roller 123 rotate, respectively, in a direction opposite to the direction of the arrows A6 and A7.

The documents placed on the document tray 103 are conveyed by the shoot roller 110 and the pick roller 111 to the position of the feeding roller 114 and the retard roller 115. On the other hand, when multiple documents are placed on the document tray 103, only the document which is one of the documents stacked on the document tray 103 and which is in in contact with the feeding roller 114 is separated and conveyed toward the document conveying direction A1 with the operation of the feeding roller 114 and the retard roller 115. At this occasion, the document has not reached the position of the first conveying roller 118 and the second conveying roller 123, and as a result, the first conveying roller 118 and the second conveying roller 123 run idle.

Subsequently, the determination module 162 determines whether (the leading edge of) the document is present at the position of the first optical sensor 116, and more specifically, whether (the leading edge of) the document has passed the position of the feeding roller 114 and the retard roller 115, based on a second document detection signal received from the first optical sensor 116 (step S104).

It should be noted that the determination module 162 may determine whether the document has passed the position of the feeding roller 114 and the retard roller 115 based on a time (the number of clocks) for which the second motor 141 and the first motor 131 are driven.

The determination module 162 waits until the document is determined to have passed the position of the feeding roller 114 and the retard roller 115. When the document has passed the position of the feeding roller 114 and the retard roller 115, the control module 161 causes the first motor 131 to generate a second driving force to rotate the retard roller 115, the first conveying roller 118, and the second conveying roller 123 in the opposite direction (step S105). As described above, the control module 161 switches the driving force generated by the first motor 131 from the first driving force to the second driving force in accordance with a determination result made by the determination module 162.

The driving mechanism (each driving force transmission module) of the document conveying apparatus 100 attains a state as illustrated in FIG. 4B in accordance with the switching from the first driving force to the second driving force. More specifically, the retard roller 115 stops, and the first conveying roller 118 and the second conveying roller 123 rotate, respectively, in the direction of the arrows A6 and A7 in FIG. 2.

a document having passed the position of the feeding roller 114 and the retard roller is conveyed by the feeding roller 114 to between the first conveying roller 118 and the first driven roller 119, and is conveyed by the first conveying roller 118 to between the first image capturing device 121*a* and the second image capturing device 121*b*.

At this occasion, the second driving force from the first motor 131 is not transmitted to the retard roller 115, and a force for rotating in a direction opposite to the direction of the arrow A5 is applied to the retard roller 115 in accordance with the rotation of the feeding roller 114, but the retard roller 115 does not rotate because of the effect of the one-way clutch 135. Therefore, even when multiple documents are stacked on the document tray 103, the retard roller 115 does not rotate in accordance with the rotation of the feeding roller 114, so that this can prevent documents other than the document in contact with the feeding roller 114 from being conveyed without being separated (multi-feed).

Subsequently, the determination module 162 determines whether (the leading edge of) the document is present at the position of the second optical sensor 120 and more specifically, whether (the leading edge of) the document has passed the position of the first conveying roller 118 and the first driven roller 119 based on a third document detection signal received from the second optical sensor 120 (step S106).

The determination module 162 waits until the document has passed the position of the first conveying roller 118 and the first driven roller 119. In a case where the document is determined to have passed the position of the first conveying roller 118 and the first driven roller 119, the image generation module 163 causes the image capturing device 121 to read the conveyed document to obtain a read image via an A/D convertor 140 (step S107).

The document read by the image capturing device 121 is discharged by the second conveying roller 123 onto the discharged sheet stacker 105.

Subsequently, the image generating module 163 transmits the read image via the interface 142 to an information processing apparatus, not shown (step S108). In a case where it is not connected to the information processing apparatus, the image generating module 163 stores the read image to the storage 150.

Subsequently, the control module 161 determines whether a document is remaining on the document tray 103 or not based on the first document detection signal received from the contact sensor 113 (step S109).

When a document is remaining on the document tray 103, the control module 161 returns back to the processing in step S103, and repeats the processing in steps S103 to S106.

At this occasion, the shoot roller 110, the pick roller 111, and the feeding roller 114 continue to rotate, respectively, in the directions of the arrows A2, A3, and A4 in FIG. 2. The retard roller 115 stops, and the first conveying roller 118 and the second conveying roller 123 continue to rotate, respectively, in the directions of the arrows A6 and A7. As a result, every time the processing in steps S106 to S109 is executed once, the documents are conveyed and read one by one.

On the other hand, in a case where a document is not left on the document tray 103, the control module 161 causes the first motor 131 to generate the first driving force only for a certain period of time (step S110), and sets the planet gear 134 to the position of FIG. 4A, and terminates the series of processing. The document conveying apparatus 100 resets the planet gear 134 at the position of FIG. 4A, so that this can reduce the time it takes for the retard roller 115 to start rotation when subsequent document reading processing is executed. It should be noted that the processing of step S110 may be omitted.

Figure 8A:
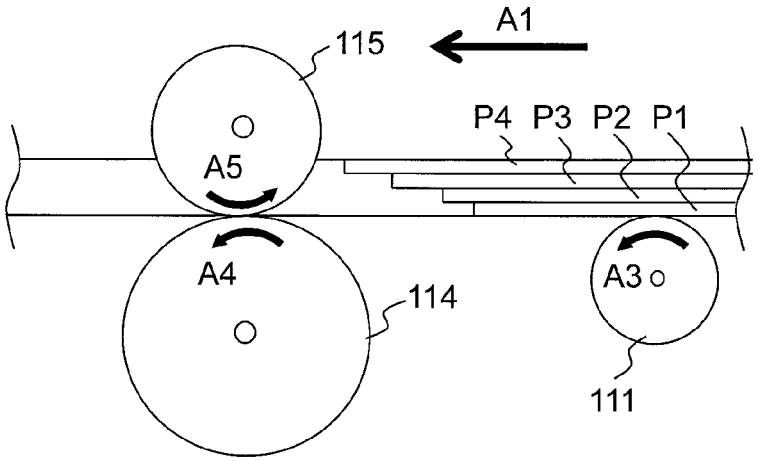
FIG. 8A is a figure for explaining why the retard roller is rotated.
Figure 8B:
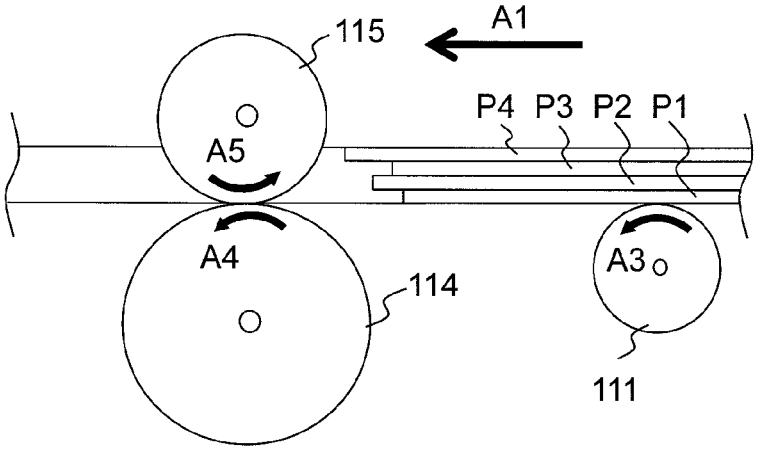
FIG. 8B is a figure for explaining why the retard roller is rotated.
Figure 8C:
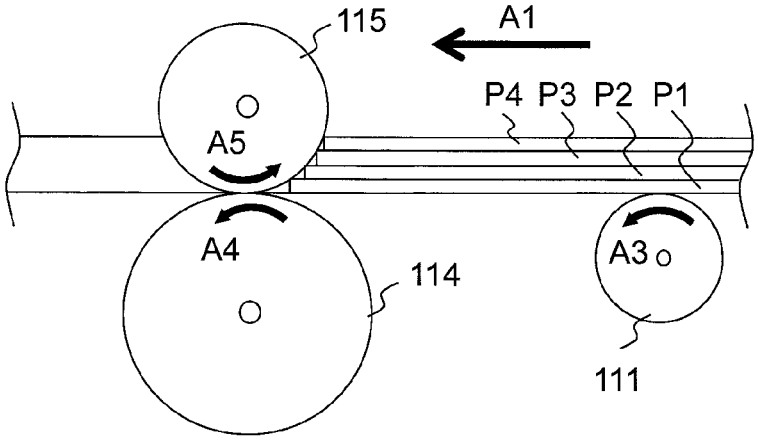
FIG. 8C is a figure for explaining why the retard roller is rotated.

FIGS. 8A to 8C are figures for explaining why the retard roller 115 is rotated only when the first document is conveyed in a case where multiple documents are to be conveyed.

When multiple documents are stacked on the document tray 103, each document may be stacked in various states depending on the users. FIG. 8A illustrates a state in which documents stacked at a higher position are placed in such a manner that their leading edges are located at the downstream side (so-called reverse taper state), and FIG. 8B illustrates a state in which the leading edges of the documents are arranged in an irregular manner (so-called leading edge irregular state).

When multiple documents are conveyed while they are stacked in the reverse taper state or the leading edge irregular state, not only the document P1 at the lowermost position in contact with the feeding roller 114 but also the other documents P2 to P4 may pass through between the feeding roller 114 and the retard roller 115, and multi-feed may occur. In contrast, as illustrated in FIG. 8C, the retard roller 115 rotates in the direction of the arrow A5, so that the documents P2 to P4 stacked at the upper side can be pushed back. As a result, the documents are in such a state in which documents stacked at a higher position are placed in such a manner that their leading edges are located at the upstream side (so-called taper state), and accordingly, multi-feed can be prevented.

On the other hand, after the document P1 placed at the lowermost position when documents are started to be conveyed, passes through between the feeding roller 114 and the retard roller 115, only the document at the lowermost position is conveyed to the downstream side due to the frictional force of the pick roller 111 and the document at the lowermost position. On the other hand, a stronger force is applied to the documents placed at the upper side of the document at the lowermost position so that the documents at the lower side are moved to the downstream side due to the frictional force between the documents caused by the weight of each document and accordingly, the taper state is maintained. Therefore, after the document P1 stacked at the lowermost position when the documents are started to be conveyed passes through between the feeding roller 114 and the retard roller 115, multi-feed is less likely to occur.

On the other hand, when the retard roller 115 is continuously rotated in the direction of the arrow A5, the leading edge of the conveyed document may be damaged. In a case where the conveyed document is a thin sheet, the documents P2 to P4 stacked at the upper side may be warped by the rotation of the retard roller 115, and a document may be jammed. However, after the document P1 stacked at the lowermost position passes through between the feeding roller 114 and the retard roller 115, multi-feed is less likely to occur, and therefore, by stopping the retard roller 115, damage at the leading edge of the document and jam can be prevented.

As described above in details, while the document conveying apparatus 100 causes the retard roller 115 to perform the separation operation, the document conveying apparatus 100 causes the first conveying roller 118 to convey the document and cuts off transmission of the driving force to the retard roller 115, in accordance with a determination result as to whether a document has passed the retard roller 115. As a result, while the document conveying apparatus 100 prevents multi-feed when the documents are started to be conveyed, multi-feed is less likely to occur, and after a document passes the retard roller 115, in other words, when a possibility of multi-feed is low, damage at the leading edge of the document and jam can be prevented. Therefore, in the document conveying apparatus 100 for driving the retard roller and the conveying roller with a single motor can appropriately control the rotation of each roller.

The document conveying apparatus 100 can drive the retard roller 115, the first conveying roller 118, and the second conveying roller 123 with the single first motor 131, and therefore, the cost can be reduced, and the electric power consumption can be reduced. After a document passes the retard roller 115, the document conveying apparatus 100 shuts off the transmission of the driving force to the retard roller 115, and therefore, degradation of each gear transmitting the driving force between the planet gear 134 and the retard roller 115 can be suppressed, and the lifetime can be increased.

The conveying mechanism of the document conveying apparatus 100 transmits the first driving force generated by the first motor 131 to the first conveying roller 118 and the second conveying roller 123 to rotate the first conveying roller 118 and the second conveying roller 123 in a direction opposite to the document conveying direction. Therefore, when a document is jammed, the document conveying apparatus 100 causes the first motor 131 to generate the first driving force, so that recovery processing for returning the document back to the document tray 103 can be smoothly executed.

Figure 9:
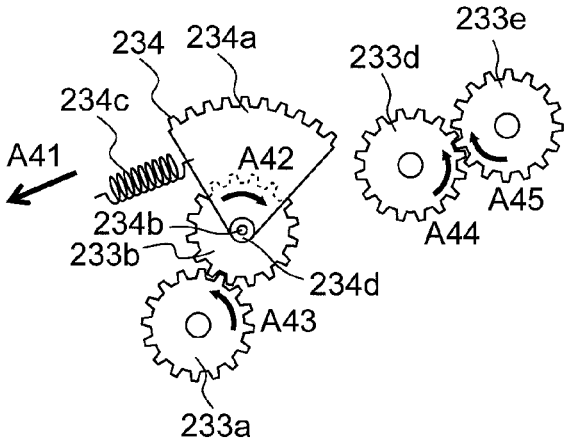
FIG. 9 is a figure for explaining an example of another driving mechanism of the document conveying apparatus 100.

FIG. 9 is a figure for explaining an example of another driving mechanism of the document conveying apparatus 100.

As illustrated in FIG. 9, the another driving mechanism of the document conveying apparatus 100 includes a first gear 233*a*, a second gear 233*b*, a fourth gear 233*d*, a fifth gear 233*e*, a gear unit 234, and the like. The gear unit 234 includes a sector gear 234*a*, a rotation shaft 234*b*, a spring 234*c*, a one-way clutch 234*d*, and the like. These units are used instead of the first to fifth gears 133*a* to 133*e* and the planet gear 134 of the driving mechanism as illustrated in FIG. 3.

The first gear 233*a* is attached to the other end of the first rotation shaft 132*a* instead of the first gear 133*a* of FIG. 3. The first gear 233*a* is engaged with the second gear 233*b*, and the second gear 233*b* uses the rotation shaft 234*b* of the sector gear 234*a* as a rotation shaft.

The spring 234*c* attached to a housing (not shown) of the document conveying apparatus 100 is attached to the sector gear 234*a*, and the spring 234*c* applies a force to the sector gear 234*a* toward the arrow A41. The one-way clutch 234*d* is attached to the sector gear 234*a*. The one-way clutch 234*d* is provided so that the sector gear 234*a* is locked and the one-way clutch 234*d* rotates together with the second gear 233*b* when the second gear 233*b* (and the rotation shaft 234*b*) rotates in the direction of the arrow A42. On the other hand, the one-way clutch 234*d* is provided so that the sector gear 234*a* becomes freely movable with respect to the second gear 233*b* when the second gear 233*b* is rotated in a direction opposite to the direction of the arrow A42.

When the second gear 233*b* (and the rotation shaft 234*b*) is rotated in the direction of the arrow A42, the sector gear 234*a* is configured to engage with the fourth gear 233*d*. The fourth gear 233*d* engages with the fifth gear 233*e*, and the fifth gear 233*e* engages with the sixth gear 133*f* in FIG. 3.

When the first motor 131 generates the first driving force, the first gear 233*a* rotates in the direction of the arrow A43, and the second gear 133*b* rotates in the direction of the arrow A42. In accordance with the rotation of the second gear 233*b*, the sector gear 234*a* engaged with the second gear 233*b* rotates in the direction of the arrow A42 and engage with the fourth gear 233*d*. In accordance with the rotation of the sector gear 234*a*, the fourth gear 233*d* and the fifth gear 233*e* rotate, respectively, in the directions of the arrows A44 and A45 and accordingly, the retard roller 115 rotates in the direction of the arrow A14 in FIG. 3.

On the other hand, when the first motor 131 generates the second driving force, the first gear 133*a* rotates in a direction opposite to the direction of the arrow A43 in FIG. 9, and the second gear 133*b* rotates in a direction opposite to the direction of the arrow A42.

The sector gear 234*a* becomes freely movable with respect to the second gear 233*b*, and rotates in a direction opposite to the direction of the arrow A42 due to the force toward the direction of the arrow A41 generated by the spring 234*c*, so that the sector gear 234*a* no longer engages with the fourth gear 233*d*. Therefore, the second driving force is not transmitted to the fourth gear 233*d*, the fifth gear 233*e*, and the retard roller 115, and as a result, each unit no longer rotates.

As described above in details, even when the sector gear 234*a* and the spring 234*c* are used instead of the planet gear 134 in the driving mechanism, the document conveying apparatus 100 can appropriately control the rotation of each roller.

However, when the sector gear 234*a* and the spring 234*c* are used in the driving mechanism, how much the retard roller 115 can be rotated is restricted by the number of teeth of the sector gear 234*a*, and therefore, this makes the apparatus design of the document conveying apparatus 100 to be complicated. Therefore, the use of the planet gear 134 in the driving mechanism is less affected by the limitation on how much the retard roller 115 can be rotated, and the document conveying apparatus 100 can be designed more easily.

Figure 10:
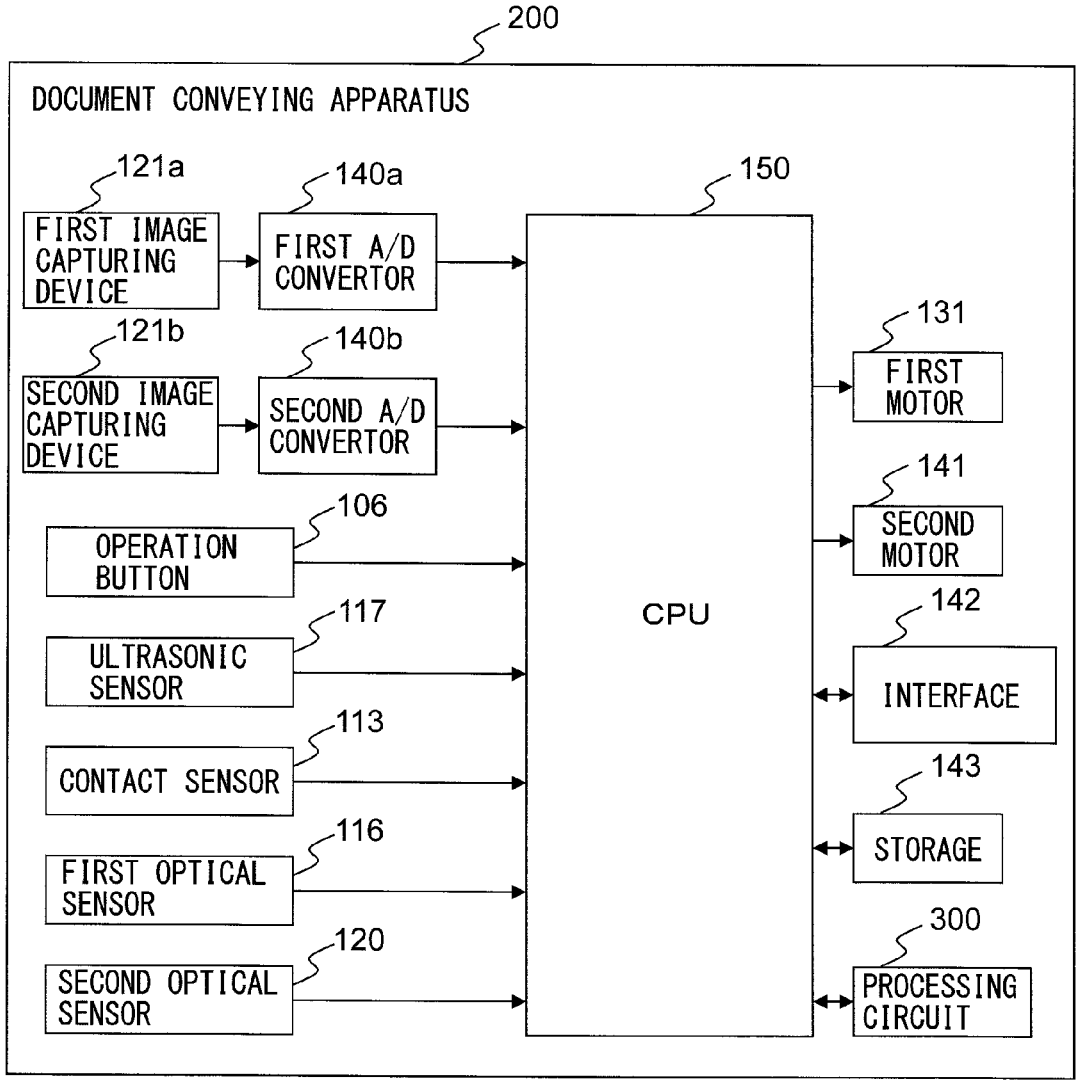
FIG. 10 is a block diagram illustrating a schematic configuration of another document conveying apparatus 200.

FIG. 10 is a block diagram illustrating a schematic configuration of a document conveying apparatus 200 according to another embodiment.

The document conveying apparatus 200 includes not only the units of the document conveying apparatus 100 but also a processing circuit 300. The processing circuit 300 is a DSP, an LSI, an ASIC, an FPGA, or the like, and executes document reading processing instead of the CPU 160.

Figure 11:
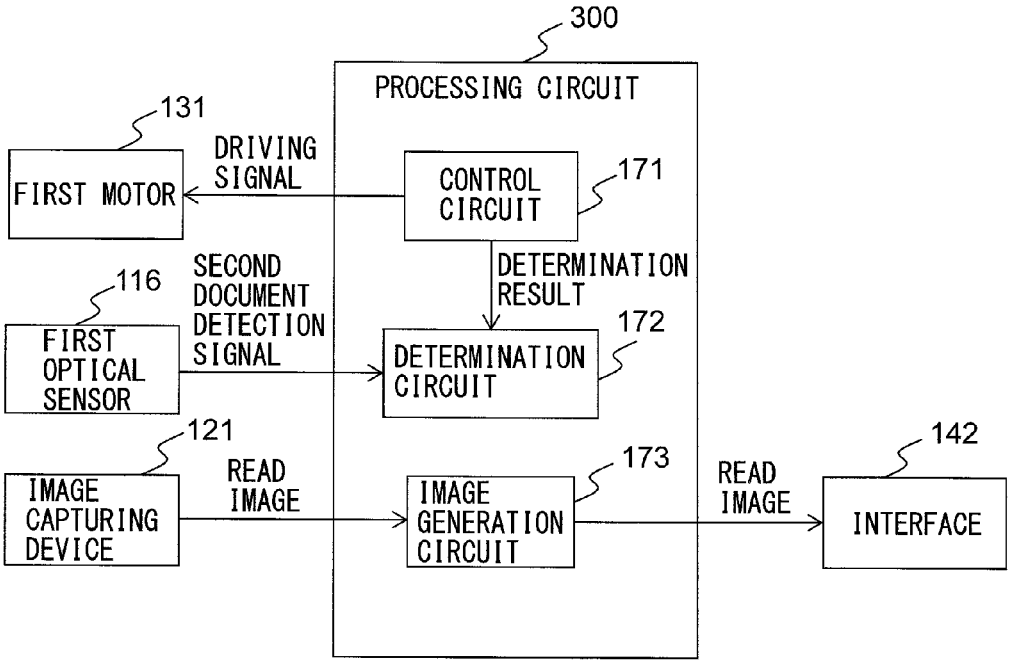
FIG. 11 is a figure illustrating a schematic configuration of a processing circuit 300.

FIG. 11 is a figure illustrating a schematic configuration of the processing circuit 300.

The processing circuit 300 includes a control circuit 171, a determination circuit 172, an image generation circuit 173, and the like. Each unit may include an integrated circuit, a microprocessor, a firmware, and the like, each of which is independent from each other.

The control circuit 171 is an example of a control module. The control circuit 171 outputs a driving signal for causing the first motor 131 to generate a driving force, and switches the driving force generated by the first motor 131 from the first driving force to the second driving force in accordance with the determination result made by the determination circuit 172.

The determination circuit 172 is an example of a determination module. The determination circuit 172 receives a second document detection signal from the first optical sensor 116, and determines whether a document has passed the retard roller 115 based on the received second document detection signal, and outputs a determination result to the control circuit 171.

The image generation circuit 173 is an example of an image generation module. The image generation circuit 173 receives a read image from the image capturing device 121, and outputs the received read image to the interface 142.

As described above in details, like the document conveying apparatus 100, the document conveying apparatus 200 can also appropriately control the rotation of each roller.

According to the document conveying apparatus, the control method, and the computer-readable, non-transitory medium, rotation of each roller can be appropriately controlled in a document conveying apparatus using a single driving force generation module to drive a separation roller and a conveying roller disposed downstream of the separation roller.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A document conveying apparatus comprising:

a feeding roller for rotating in a document conveying direction to feed a document;

a separation roller, provided at a position facing the feeding roller, for rotating in a direction opposite to the document conveying direction to separate documents;

a conveying roller provided at a downstream with respect to the separation roller in the document conveying direction;

a driving force generator configured to be capable of generating a first driving force with a rotation in a first direction, and capable of generating a second driving force with a rotation in a second direction opposite to the first direction;

a driving force transmitter disposed between the driving force generator and the separation roller and between the driving force generator and the conveying roller;

a processor for determining whether a document has passed the separation roller and for switching a driving force generated by the driving force generator from the first driving force to the second driving force in accordance with a determination result made by the processor, wherein the driving force transmitter performs a separation operation by transmitting the first driving force to the separation roller, and conveys the documents by transmitting the second driving force to the conveying roller and cuts off transmission of the second driving force to the separation roller, in accordance with a switching from the first driving force to the second driving force, wherein the driving force transmitter further includes a one-way clutch for blocking the rotation of the separation roller in the document conveying direction, and wherein the driving force transmitter includes a planet gear, so that the driving force transmitter transmits the first driving force via the planet gear to the separation roller, and a coupling of the planet gear is changed in accordance with the switching from the first driving force to the second driving force, whereby a transmission of the second driving force to the separation roller is cut off.

2. The document conveying apparatus according to claim 1, wherein the driving force transmitter rotates the conveying roller in a direction opposite to a document conveying direction by transmitting the first driving force to the conveying roller.

3. A control method for a document conveying apparatus including a feeding roller for rotating in a document conveying direction to feed a document, a separation roller, provided at a position facing the feeding roller, for rotating in a direction opposite to the document conveying direction to separate documents, a conveying roller provided at a downstream with respect to the separation roller in the document conveying direction, a driving force generator configured to be capable of generating a first driving force with a rotation in a first direction, and capable of generating a second driving force with a rotation in a second direction opposite to the first direction, a driving force transmitter disposed between the driving force generator and the separation roller and between the driving force generator and the conveying roller, the control method comprising:

determining whether a document has passed the separation roller; and switching a driving force generated by the driving force generator from the first driving force to the second driving force in accordance with a determination result in the determining step, wherein the driving force transmitter performs a separation operation by transmitting the first driving force to the separation roller, and conveys the documents by transmitting the second driving force to the conveying roller and cuts off transmission of the second driving force to the separation roller, in accordance with the switching from the first driving force to the second driving force, wherein the driving force transmitter further includes a one-way clutch for blocking the rotation of the separation roller in the document conveying direction, and wherein the driving force transmitter includes a planet gear, so that the driving force transmitter transmits the first driving force via the planet gear to the separation roller, and a coupling of the planet gear is changed in accordance with the switching from the first driving force to the second driving force, whereby a transmission of the second driving force to the separation roller is cut off.

4. A computer-readable, non-transitory medium storing a computer program, wherein the computer program causes a document conveying apparatus including a feeding roller for rotating in a document conveying direction to feed a document, a separation roller, provided at a position facing the feeding roller, for rotating in a direction opposite to the document conveying direction to separate documents, a conveying roller provided at a downstream with respect to the separation roller in the document conveying direction, a driving force generator configured to be capable of generating a first driving force with a rotation in a first direction, and capable of generating a second driving force with a rotation in a second direction opposite to the first direction, a driving force transmitter disposed between the driving force generator and the separation roller and between the driving force generator and the conveying roller, to execute a process, the process comprising:

determining whether a document has passed the separation roller; and switching a driving force generated by the driving force generator from the first driving force to the second driving force in accordance with a determination result in the determining step, wherein the driving force transmitter performs a separation operation by transmitting the first driving force to the separation roller, and conveys the documents by transmitting the second driving force to the conveying roller and cuts off transmission of the second driving force to the separation roller, in accordance with the switching from the first driving force to the second driving force, wherein the driving force transmitter further includes a one-way clutch for blocking the rotation of the separation roller in the document conveying direction, and wherein the driving force transmitter includes a planet gear, so that the driving force transmitter transmits the first driving force via the planet gear to the separation roller, and a coupling of the planet gear is changed in accordance with the switching from the first driving force to the second driving force, whereby a transmission of the second driving force to the separation roller is cut off.

* * * * *